US006405710B1

(12) United States Patent
Brehob et al.

(10) Patent No.: US 6,405,710 B1
(45) Date of Patent: Jun. 18, 2002

(54) INTERNAL COMBUSTION ENGINE HIGH PRESSURE FUEL INJECTION SYSTEM WITH SELECTABLE FUEL RAIL VOLUME

(75) Inventors: Diana Dawn Brehob, Dearborn, MI (US); Yitzhak Isaac Henig, Billericay (GB)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/560,231

(22) Filed: Apr. 28, 2000

(51) Int. Cl.[7] ..... F02M 41/00
(52) U.S. Cl. ..... 123/456; 123/447
(58) Field of Search ..... 123/456, 447, 123/457, 458, 467

(56) References Cited

U.S. PATENT DOCUMENTS

| | | | | | |
|---|---|---|---|---|---|
| 4,674,448 | A | * | 6/1987 | Steiger | 123/23 |
| 4,719,889 | A | * | 1/1988 | Amann et al. | 123/447 |
| 5,245,970 | A | * | 9/1993 | Iwaskiewicz et al. | 123/447 |
| 5,522,364 | A | * | 6/1996 | Knight et al. | 123/467 |
| 5,732,679 | A | * | 3/1998 | Takahasi et al. | 123/467 |

* cited by examiner

*Primary Examiner*—Willis R. Wolfe
*Assistant Examiner*—Mahmoud Gimie
(74) *Attorney, Agent, or Firm*—Allan J. Lippa

(57) ABSTRACT

A high pressure fuel injection system for an internal combustion engine has a small volume fuel rail and a large volume fuel rail. The engine's control unit selects between the two rails. The small volume rail is used for engine start and the large volume rail is used as soon as operating rail pressure has been attained in both rails.

16 Claims, 2 Drawing Sheets

INTERNAL COMBUSTION ENGINE HIGH PRESSURE FUEL INJECTION SYSTEM WITH SELECTABLE FUEL RAIL VOLUME

TECHNICAL FIELD

The present invention relates to a high pressure fuel injection system with a common rail design in which the rail internal volume is selectable between a smaller volume which may be used, for example, during engine starting and a larger volume for steady state operation beneficially characterized by lessened pressure fluctuation.

DISCLOSURE INFORMATION

Designers of common rail fuel injection systems for internal combustion engines must compromise between low internal volume to allow rapid engine starting and high rail volume which serves as a capacitance to damp out pressure waves that are induced when the injector flows start and stop.

The engine must fire within a fraction of a second from the time of key on to be driver acceptable. In this short period of time, the high pressure fuel pump must bring the rail pressure sufficiently high to support reasonable combustion, i.e., robust, avoiding high emissions, and generating sufficient power to start up the engine. Measures taken to ensure rapid starts include limiting the internal volume of the rail and selecting a pump design with sufficient pumping capacity. The latter measure leads to the pump to be of higher capacity than otherwise needed and in turn higher frictional losses.

Another constraint on the common rail is the need to damp reflecting pressure waves that are caused by the intermittent flow through the fuel injectors. Not only do pressure waves exist due to each injector's actions separately, but the individual pressure waves are summed in the common rail and may reinforce each other or resonate under some operating conditions. The problem which pressure waves cause is uneven metering. The amount of fuel which is injected is a function of pulse width, pressure drop across the fuel nozzle, the cross-sectional area of the nozzle orifice, the number of orifices, and the discharge coefficient across the orifice. If the pressure in the fuel line is fluctuating, particularly on the time scale of an injection event (order of a millisecond) fuel metering becomes complicated. To alleviate this difficulty, measures taken include maximizing the internal volume of the rail and selecting an internal geometry which attenuates the pressure waves. Large internal volume of the rail attenuates pressure waves due to the fact that liquid fuels, although normally thought of as incompressible, are quite compressible at the pressures existing in diesel fuel injection systems (order of 1800 bar). The larger the internal volume of the rail, the greater the capacitance and the desired damping is achieved. However, as mentioned above, increases in internal volume negatively affect engine starting, i.e., there is a constraint on how far internal volume can be increased. Another measure taken to suppress pressure waves is to design the internal space of the rail to contain a spherical chamber in which the isotropy of the inside surface tends to confound the pressure waves, i.e., bouncing unpreferentially in all directions such that reinforcement of the individual waves is lessened.

From the above discussion, the desired fuel rail internal volume must selectively be small or large to satisfy conflicting demands. In actuality, a fuel rail volume which satisfactorily bridges the compromise does not exist. Thus, additional measures are taken to facilitate the quick starting and minimal pressure fluctuation desired. If the fuel rail could be as small as desirable for rapid starting, the demands on the fuel pump would be lessened; a pump with fewer and/or smaller plungers might be employed. This would measurably improve cold start fuel consumption and directionally improve fuel consumption over the remainder of the operating map. Another potential advantage would be to change pump drive ratio, which would allow the use of a smaller pump operating at higher speed. To satisfy the need to dampen pressure fluctuations, a large internal rail volume is desired but cannot be achieved without harming starting times. A measure helping to reduce pressure fluctuations within the rail is a spherical internal rail geometry. The disadvantage is that this construction is more expensive than a cylindrical internal geometry.

SUMMARY OF THE INVENTION

The subject of the invention disclosed herein is a high pressure fuel injection system for an engine which includes both a small and a large volume rail. The small volume rail can be isolated from the large volume rail when necessary for engine start. By having the rail volume selectable between the smaller and larger volumes, both rapid start and low pressure fluctuation in the common rail during normal operation can be attained without compromising the system.

After the ignition key is turned on, the engine's control system selects the appropriate valve positions so that the large volume rail is not in communication with the small volume rail. As the high pressure fuel pump raises pressure in the small rail to a satisfactory pressure for robust operation, a variable valve located between the small and large volume rails and controlled by the engine controller is partially opened. As used herein, the term variable valve means pulse width modulated, variable opening, or other type of valve known to those skilled in the art and suggested by this disclosure.

Opening of the variable valve causes the pressure in the large volume rail to rise. After the large volume rail pressure attains an operating level, a valve located in between the high pressure pump and the large volume rail and the variable valve are opened fully. At this point steady-state, normal engine operation has been achieved.

A high pressure fuel injection system for a reciprocating internal combustion engine having at least two cylinders includes a fuel supply line connected to a high pressure pump, a fuel line containing a valve connecting the high pressure fuel pump to a large volume rail, a fuel line connecting the high pressure fuel pump to a small volume rail, a fuel line containing a variable valve connecting the large volume and small volume rails with a variable valve, and fuel lines from the small volume rail to the fuel injectors. Pressure transducers may be installed in both the large and small volume rails.

A method for selecting between a small volume rail and a large volume rail in a high pressure fuel system for a reciprocating internal combustion engine comprises the steps of initiating cranking of said internal combustion engine upon sensing key on, closing a valve in a fuel line between a high pressure fuel pump and the large volume rail, closing a valve in the fuel line between the large volume rail and the small volume rail, opening the valve in the fuel line between the large volume rail and the small volume rail after a predetermined time following cranking, and opening the valve in the fuel line between the high pressure fuel pump and the large volume rail after a predetermined time following cranking. The valve between the large volume rail and small volume rail is opened successively according to a schedule based on sensors measuring engine operating parameters including at least engine speed.

Alternatively, the opening of the valve in the fuel line between the large volume rail and the small volume rail may be determined based on pressure measured in the small volume rail. Furthermore, the valve located in between the large volume rail and small volume rail is opened variably such that the pressure in the small volume rail does not drop substantially below normal operating pressure. Similarly, the valve in the fuel line between the high pressure fuel pump and the large volume rail may be opened when a pressure transducer disposed in the large volume rail indicates that the pressure in the large volume rail is within a predetermined fraction of normal operating pressure.

The total internal volume of the low volume rail (including all valves, lines, etc.) should be proportional to the number of cylinders times volume per injection during engine start supplemented by a small margin. The purpose of the margin is to account for system variations such as the effect of ambient temperature on the hydraulic losses in the system.

Other advantages, as well as objects and features of the present invention, will become apparent to the reader of this specification.

DETAILED DESCRIPTION OF PREFERRED EMBODIMENTS

Figure 1:
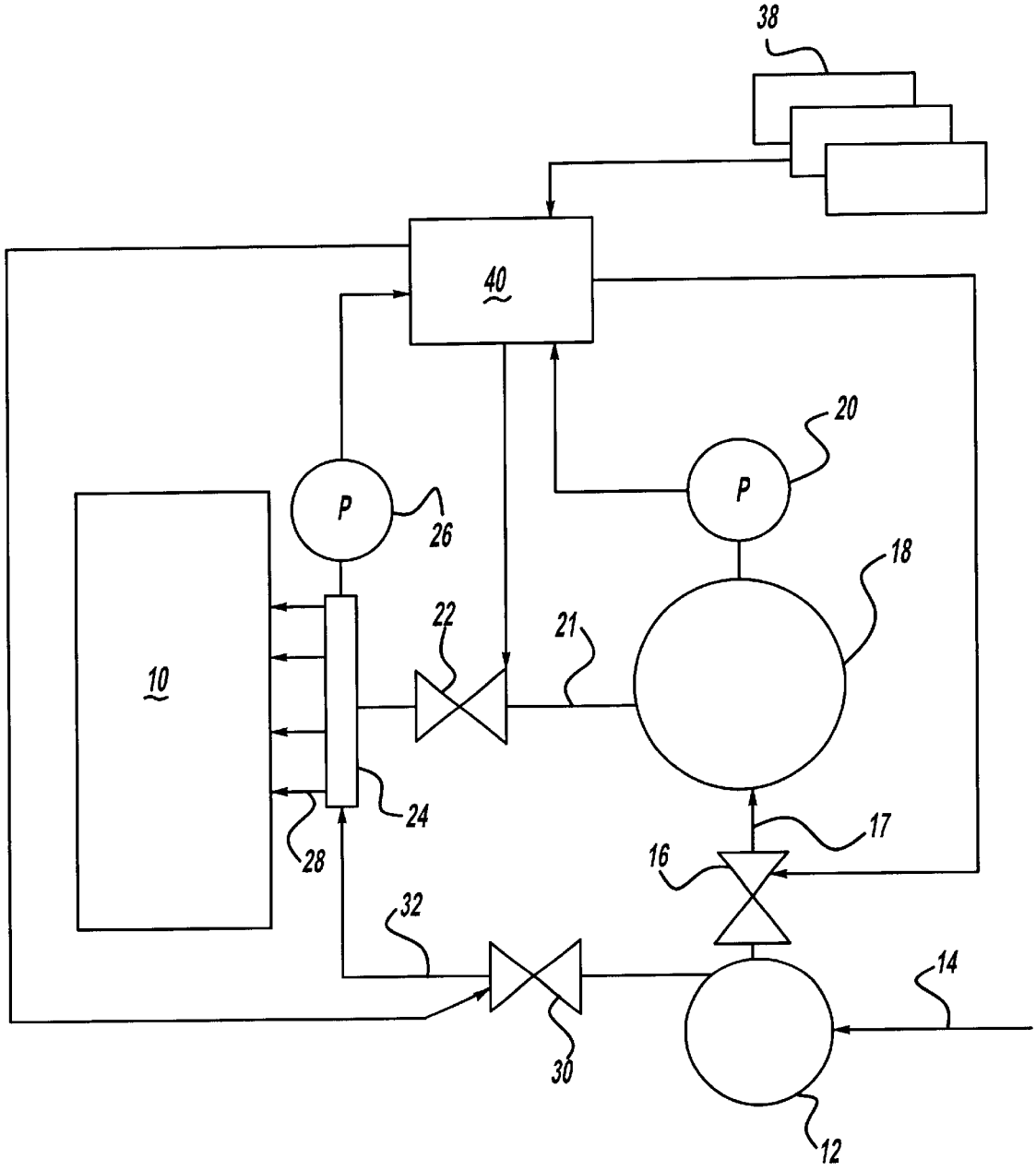
FIG. 1 is a schematic representation of an engine having a high pressure fuel system according to one aspect of the present invention.

According to the present invention, a fuel injection system, as shown in FIG. 1, is a common rail system. A high pressure fuel pump 12 is supplied by low pressure fuel through fuel line 14. The high pressure fuel pump 12 supplies fuel to fuel line 32 when valve 30 is open. Fuel line 32 is connected to the low volume rail 24. The high pressure fuel pump 12 also has an output fuel line 17 connected to a large common rail 18. Valve 16 in fuel line 17 determines whether fuel flows from the high pressure fuel pump 12 through fuel line 17 to the large common rail 18. On/off solenoid control valves 16 and 30 select between the small and large rails as the operating strategy requires. Fuel line 21 extends between small volume rail 24 and large volume rail 18, with valve 22 controlling flow in fuel line 21. Valve 22 is normally open and pulse width modulated (or controlled in an alternative variable method). By closing both valves 16 and 22, small volume rail 24 is isolated from large volume rail 18 during the engine starting procedure at which time small total internal rail volume is desired. As pressure in the small volume rail 24 approaches a predetermined operating pressure, the duty cycle on valve 22 decreases. As the pressure in large volume rail approaches that of the small volume rail 24, the duty cycle on valve 22 approaches 0%, i.e., valve 22 is open.

Engine control unit 40 receives inputs from pressure transducers 20 and 26, which are installed in large volume rail 18 and small volume rail 24, respectively.

Valves 16 and 30 are operated (opened or closed) by engine control unit 40 based on time since engine start or the pressures indicated by transducers 20 and 26. Engine control unit 40 also controls valve 22 to the appropriate variable position based on the time since engine start or based on the pressures sensed by pressure transducer 26. Valve 22 follows a predetermined schedule from its closed to its open position. In general, valve 22 is adjusted toward an open position as much as possible based on feedback of system pressures from transducers 20 and 26.

In certain engine applications, it may be possible to eliminate valve 30 from the system, i.e., it may not be necessary to isolate the low volume rail from the system during steady-state warmed up operation. In certain applications, it may be beneficial to trickle flow through the low volume circuitry. If such is the case, valve 30 may be eliminated from the system.

The engine start sequence occurs in the following manner. At key on, valve 16 is closed and valve 30 is opened, (FIG. 1). Also, valve 22, which is a normally open, pulse width modulated solenoid valve, is closed, i.e., duty cycle of 100%. As engine 10 begins to crank, high pressure fuel pump 12 spins and pressure builds in small volume rail 24 and lines 32 and 28. As pressure within small volume rail 24 approaches the desired operating pressure, the duty cycle of valve 22 is decreased, thereby bringing up the pressure in the large volume rail 18. The duty cycle is controlled by engine controller 40 so as to bring up the pressure in the large volume rail 18 and associated lines 17 and 21 as quickly as possible without degrading the pressure in the low volume rail 24 and associated lines 32 beyond an acceptable margin. When the pressure in large volume rail 18 rises to nearly operating pressure, valve 22 can be operated with 0% duty cycle, i.e., assume its normally open position. Shortly thereafter, valve 16 is opened and valve 30 is closed.

Figure 2:
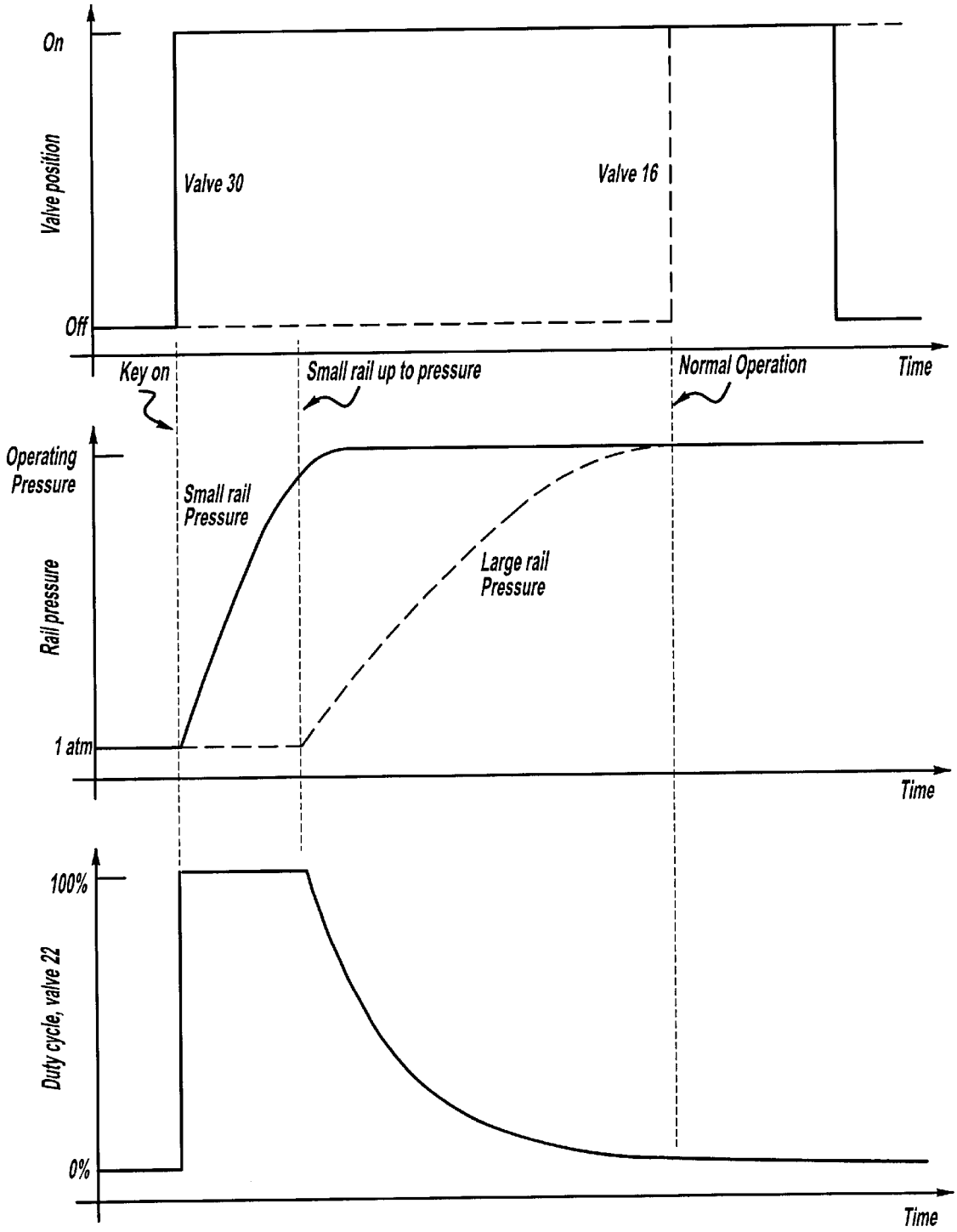
FIG. 2 is an example of a timeline of an engine starting procedure according to another aspect of the present invention.

The starting sequence is shown in FIG. 2 on a time basis after key on. Valve 30 is opened and valves 22 and 16 are closed. Valve 22 is a normally open, variable valve; thus, it operates at 100% duty cycle when closed. As pump 12 turns, the pressure in small rail 24 rises rapidly. Before pressure completely reaches operating pressure, the duty cycle of valve 22 is decreased by engine controller 40 (i.e., valve 22 begins to open) allowing pump 12 to pressurize fuel in larger rail 18. Large volume rail 18 takes longer to pressurize because of its larger volume. Flow through valve 22 is the reverse direction during this start period compared to normal, that is, fuel flows from the smaller rail toward the larger rail. As the larger rail approaches operating pressure, the duty cycle of valve 22 approaches 0% and valve 16 is opened so that fuel flows from the large rail to the smaller rail to the injectors. At this time, the small rail circuitry is no longer needed, and valve 30 can be closed shortly after normal operation has been attained.

While the best mode for carrying out the invention has been described in detail, those familiar with the arts to which this invention relates will recognize alternative designs and embodiments for practicing the invention. Thus, the above-described preferred embodiment is intended to be illustrative of the invention, which may be modified within the scope of the following claims.

We claim:

1. A high pressure fuel injection system for a reciprocating internal combustion engine having at least two cylinders, with said fuel injection system comprising:

a fuel supply line connected to a high pressure fuel pump;

a fuel line connecting said high pressure fuel pump to a large volume rail;

a first valve disposed in said fuel line between said high pressure fuel pump and said large volume rail;

a fuel line connecting said high pressure fuel pump to a small volume rail;

a fuel line connecting said large volume rail to said small volume rail;

a second valve disposed in said fuel line between said large volume rail and said small volume rail; and fuel lines connecting said small volume rail to fuel injectors, with one of said injectors supplying fuel to each cylinder.

2. A fuel injection system according to claim 1, wherein said valve disposed in said fuel line between said large volume rail and said small volume rail is a variable type valve.

3. A fuel injection system according to claim 1, further comprising a pressure transducer disposed in said large volume rail.

4. A fuel injection system according to claim 1, further comprising a pressure transducer disposed in said small volume rail.

5. A fuel injection system according to claim 1, further comprising an electronic control unit for operating said first and second valves.

6. A fuel injection system according to claim 1, further comprising a third valve disposed in said fuel line connecting said high pressure pump with said small volume rail.

7. A fuel injection system according to claim 1, in which the total internal volume of said small volume rail is proportional to the product of number of cylinders and the fuel volume per injection during engine start.

8. A fuel injection system according to claim 1, in which said total internal volume of said small volume rail is at least 110% of said product of number of cylinders and the fuel volume per injection during engine start.

9. A method for selecting between a small volume rail and a large volume rail in a high pressure fuel system for a reciprocating internal combustion engine comprising the steps of:

initiating cranking of said internal combustion engine upon sensing key on;

closing a valve disposed in a fuel line between a high pressure fuel pump and said large volume rail;

closing a valve disposed in a fuel line between said large volume rail and said small volume rail;

opening said valve disposed in said fuel line between said large volume rail and said small volume rail after a predetermined time following the beginning of said cranking;

opening said valve disposed in said fuel line between said high pressure fuel pump and said large volume rail after a predetermined time following said cranking; and opening said valve disposed in said fuel line between said large volume rail and said small volume rail variably with said valve opened successively according to a schedule and with said schedule being predetermined such that the pressure in said small volume rail does not drop substantively below a normal operating pressure.

10. A method according to claim 9, further comprising the step of opening said valve disposed in said fuel line between said large volume rail and said small volume rail variably with said valve being opened successively according to a schedule with said schedule based on sensors measuring operating parameters including at least engine speed.

11. A method according to claim 9, further comprising the step of closing a valve disposed in the fuel line between said high pressure pump and said small volume rail when said valve disposed in said fuel line connecting said small volume rail and said large volume rail is fully open.

12. A method for selecting between a small volume rail and a large volume rail in a high pressure fuel system for a reciprocating internal combustion engine comprising the steps of:

initiating cranking of said internal combustion engine upon sensing key on; closing a valve disposed in a fuel line between a high pressure fuel pump and said large volume rail;

closing a valve disposed in a fuel line between said large volume rail and said small volume rail;

opening said valve disposed in said fuel line between said large volume rail and said small volume rail when a pressure transducer disposed in said small volume rail indicates that pressure in said small volume rail is within a predetermined fraction of a normal operating pressure; and opening said valve disposed in said fuel line between said high pressure fuel pump and said large volume rail when a pressure transducer disposed in said large volume rail indicates that pressure in said large volume rail is within a predetermined fraction of said normal operating pressure.

13. A method according to claim 12, further comprising the step of opening said valve disposed in said fuel line between said large volume rail and said small volume rail variably, said valve opened such that said pressure in said small rail, as determined by said pressure transducer in said small rail, does not drop substantively below normal operating pressure.

14. A method according to claim 12, further comprising the step of opening said valve disposed in said fuel line between said large volume rail and said small volume rail variably with said valve being opened successively according to a schedule with said schedule being based on sensors measuring operating parameters including at least engine speed.

15. A method according to claim 12, further comprising the step of closing a valve disposed in the fuel line between said high pressure pump and said small volume rail when pressure in said large volume rail is within a predetermined fraction of normal operating pressure.

16. A method according to claim 12, further comprising the step of closing a valve disposed in the fuel line between said high pressure pump and said small volume rail when said valve disposed in fuel line between said large volume rail and said small volume rail is fully open.

* * * * *